United States Patent [19]

Eschner et al.

[11] 4,268,016

[45] May 19, 1981

[54] VALVE ELEMENT FOR SLIDING TYPE VALVE JOINTS ON THE OUTLET OF VESSELS CONTAINING MOLTEN METAL AND PROCESS FOR MAKING SAME

[75] Inventors: Axel Eschner, Wiesbaden; Hermann Leupold; Peter Jeschke, both of Walluf, all of Fed. Rep. of Germany

[73] Assignee: Didier-Werke AG, Wiesbaden, Fed. Rep. of Germany

[21] Appl. No.: 47,678

[22] Filed: Jun. 12, 1979

[30] Foreign Application Priority Data

Jun. 19, 1978 [DE] Fed. Rep. of Germany ..... 2826709

[51] Int. Cl.[3] ..... C21C 5/42

[52] U.S. Cl. ..... 266/236; 137/341; 222/593; 222/600; 266/271

[58] Field of Search ..... 222/593, 600; 137/341; 266/271, 272, 236

[56] References Cited

U.S. PATENT DOCUMENTS

| | | | |
|---|---|---|---|
| 2,943,370 | 7/1960 | Murarsheed | 266/236 |
| 3,018,789 | 1/1962 | Pagonis | 137/341 |
| 3,581,948 | 6/1971 | Detalle | 266/236 |
| 4,076,153 | 2/1978 | Tinnes | 222/600 |
| 4,175,974 | 11/1979 | Grabner et al. | 222/600 |

*Primary Examiner*—L. Dewayne Rutledge
*Assistant Examiner*—John P. Sheehan
*Attorney, Agent, or Firm*—Jim Zegeer

[57] ABSTRACT

An electrically heated valve element for sliding type valve joints in the outlet of a molten metal vessel has an electrical heating conductor disposed predominately in the outlet closing surface section of the valve element so that when moved to the casting position where the molten metal flow passage aligns with the flow passage from the vessel, the outlet closing surface of the element is maintained at a uniformly high temperature so that any cooling down of the outlet closing surface is avoided. The valve element is made by embedding the heating conductor which is air annealed nichrome wire in spiral form, into the refractory material of the valve element by vibration, the embedding mass being free of organic substances, carbon, sulfur, metallic iron, alkalies and/or electrically conductive substances.

23 Claims, 2 Drawing Figures

FIG. 1 PRIOR ART
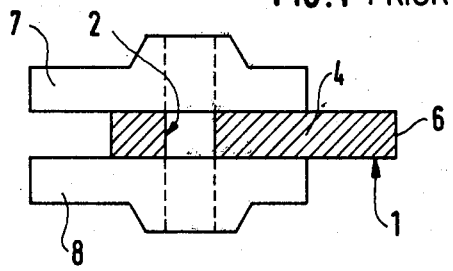
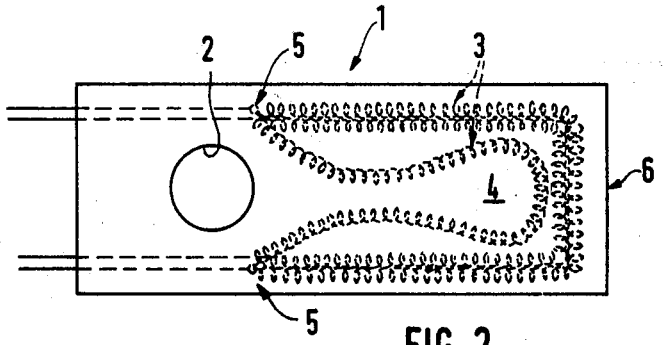
FIG. 2

VALVE ELEMENT FOR SLIDING TYPE VALVE JOINTS ON THE OUTLET OF VESSELS CONTAINING MOLTEN METAL AND PROCESS FOR MAKING SAME

The invention relates to improvements in valve plates for the outlet passages of molten metal vessels and a process for making such valve plates.

Such valve plates are known, for example, from Swiss Pat. No. 444,390 incorporated herein by reference.

Prior to this invention in order to avoid any freezing of the metal melt in the valve plate, the heating conductor was provided as immediately adjacent as possible to the flow passage, because thereby one hoped for the greatest possible degree of effectiveness of the heating conductor, namely immediately adjacent to the area subject to freezing-up.

However, it turned out, especially in the case of molten metal vessels containing three plate slides for aluminum melt, that the freezing problem may be solved in a fairly satisfactory manner, to be sure, but that in the case of such sliding value element, especially also because of the particular characteristics of the liquid aluminum, considerable sealing problems occur.

It is the object of the present invention to solve this problem and particularly to create a valve plate of this type, in case of which, the freezing of the metal melt will be avoided in an effective manner, leakages on the plate slide are avoided, and which may also be produced in a simple manner.

According to the invention this task is solved in a suprisingly simple and nonobvious manner by disposing or locating the heating conductor overwhelmingly in the closing surface section of the valve plate. As a result of this solution to the problem there is avoided, for example, liquid aluminum melt getting between the plates of the sliding valve plate, freezing there and leading to the destruction of the plates after repeated opening and closing of the sliding valve plate. The effect of this characteristic of the invention rests on the fact, that the closing section of the valve plate projecting freely, laterally horizontally or vertically upward in position from the sliding valve plate, does not cool down as it did prior to this invention, and thus contracts as a result of reversion of the thermal cover, but that the heating of this closing surface section too takes place on the basis of the arrangement of the heating conductor not only around the flow passage but preferably and overwhelmingly also in the closing surface section. The operating surface of the valve plate in the area of the closing surface may therefore be sealed perfectly, and prevent any breaking out of the metal melt through cracks, occurring otherwise. For this purpose, for example, the valve plate may additionally also be insulated in the area of the closing surface section, by applying for example Pyrostop felt on to the steelhousing accomodating the plate.

Metal wires may be used in a known manner as the heating conductor, but one may also embed non-metallic heating conductors when it is desired, for example, to achieve higher operating temperatures. With metal wires as well as with corresponding non-metallic heating conductors, it will be possible in a very simple manner, in the casting position of the valve plate, to keep not only the immediate vicinity of the flow passage but also the closing surface section of the plate at a temperature which lies above the melting temperature of the metal to be cast.

In order to obtain a desired solution in a simple manner of both the problems of freezing as well as of that of sealing, the heating conductor at least partially enclosed the valve plate flow passage on the side of the closing surface section, whenever the heating conductor has a metal wire. The heating conductor at the same time is thus guided in from the side opposite the closing surface section of the plate and is for example, in the shape of a U opened toward this side, around the flow passage of the plate.

In a preferred form, the electrical heating conductor is in the form of a spiral, preferably a double spiral so the closing surface section of the valve plate may be kept a uniformly high termperture of for example, 750° C. In this case too, the part of the valve plate which is in casting position without cover, there is a stronger heating than in the remaining sections of the plate, so that a cooling down will be avoided and the sliding remains tight. A double spiral will not only guarantee a more uniform heating and a higher performance, it also ensures the operability of the valve plate of the invention even if one spiral opens and fails.

To further assure as uniform heating possible in the closing surface section, the branches of the double spiral lie in refractory material of the plate and constitute a plurality of branches each branch having the same electrical resistance. At the outside part of the closing section an additional separately controlled heating conductor may be disposed, which is switched on electrically only in the casting position, one may achieve in a simple manner that essentially the same temperature will prevail in the casting position in the closing surface section of the valve plate as in the immediate vicinity of the valve plate, covered up by the one or several stationary plates, in the immediate vicinity of the flow passage.

This temperature compensation may also be achieved by having the heating conductors on the inside and outside sections of the closing surface portion of the valve plate developed as heating spirals with the outside heating conductor having a smaller spacing if turns than the lower heating conductor.

The particular direction of the branches of the heating conductor is that the inside spiral of the double spiral referred to above lies directly behind the flow passage in the closing surface section and is closer to the longitudinal center median of the plane of the plate valve than in the area of the flow passage and serves likewise for the uniform heating of the part of the valve plate, which lies in all operating positions on or between the one or several plates.

Preferably a nichrome wire is used as a heating conductor. It has indeed turned out that such wires in valve plates of the type of the invention have a long useful life. The ratio of the thickness of the valve plate to the diameter of the turn of the heating spiral lies between 3:1 and 6:1 and preferably, is at about 4:1. The ratio of the diameter of the turn of the heating spiral to the diameter of the wire lies at about 6:1 and preferably at about 7.5:1. The ratio of the spacing of the turn of the heating spiral to the spacing of the upper edge of the heating wire to the surface of the plate lies below 1:4, preferably 1:2. With the above dimensional guides for the ratio of the thickness of the plate to diameter of heating spiral, an optimum between the surface effect of the heating wire and an heating of the surface of the valve plate in the area of the heating wire will be achieved. With the above dimensional guide of the ratio of diameter of the turn of the heating spiral to diameter of wire, disadvantageous changes of the cross section of the heating wire during winding, will be avoided. The above given ratio of the spacing of the turns to the spacing of the upper edge of the heating wire to the plate surface guarantees an optimum removal of the heat from the heating wire and a uniform heating of the surface of the valve plate. Over-heatings of the surface are avoided.

The embedding of the heating conductor in the form of a metallic wire into the refractory material of the valve plate, as is well known, causes difficulties, since changes of the cross section of the heating wire are to be avoided and a high span of useful life of the heating conductor is to be ensured.

The invention therefore also relates to an advantageous process for the production of the initially mentioned valve plate with due consideration of the last mentioned requirements.

This process for forming the electrically heated valve plate according to the invention is distinguished from the art by the measure embedding the heating conductor into a hydraulically or chemically setting mass of "TABULAR"—alumina, a calcium—aluminate cement and water and/or mono-aluminum phosphate. In case of the necessary dimensioning of the heating wire an increase of the surface load as compared to the customary values to values around 10 watts/cm$^2$ surface of the wire is unavoidable. For this reason, increased demands for purity are to be made of the embedding mass and the binder. This prerequisite is fulfilled by the is embedding mass which guarantees a suprisingly good corrosion resistance of the metallic heating conductor.

The greatest possible purity of the embedding mass is to be ensured when the embedding mass is essentially free of organic substance, carbon, sulfur, metallic iron, alkalies and/or electrically conductive substances. Any addition of retarders, inhibitors, liquefiers or accelerators, as long as the latter are of organic origin, is to be avoided.

Since, as has already been mentioned, changes of the cross section in the heating conductor and a particularly careful and gentle treatment of the heating conductor is required during embedding, during fabrication of the valve plate, a vibrating embedding mass is used and the heating conductor is embedded by vibration into the mass.

Corrosion resistance of the nichrome wire is increased by annealing same in air to form a protective layer of nickel oxide. After annealing, the heating wire should be touched by hand only at the connecting ends. The connecting ends should be twisted at least twice or three times in order to keep any heating up of the connecting ends in air as low as possible.

During the vibration process according to the invention, for the embedding of the heating conductors into the plate material a uniform filling of the heating spirals will be achieved, whereby a certain filtering action of the spiral is followed by an enrichment of cement in the spiral, which improves the corrosion resistance. At the same time, it is possible, because of the vibration process to even use embedding masses with a grain size of maximally 1.1 to 1.5 times the spacing of the turn of the heating spiral, which in certain areas is greater than the spacing of a turn of the heating spiral. As a result of that the strength of the valve plate may be improved and the susceptibility to fissures and contraction during setting may be decreased.

BRIEF DESCRIPTION OF THE DRAWINGS

Further objects, feature, advantages and possibilities of application of the invention will become apparent from the following description taken in conjunction with the accompanying drawings wherein:

FIG. 1 shows in cross section, diagrammatically a three plate slide valve for aluminum furnaces of the type shown in Swiss Pat. No. 444,390, in case of which the doctrine according to the invention is preferably applied, and FIG. 2 shows in top view a valve center plate for a three plate slide according to FIG. 1.

DETAILED DESCRIPTION OF THE INVENTION

The valve plate 1, according to FIG. 1 is shown, as the center plate, in casting position of a three plate slide between a stationary top plate 7 and a stationary bottom plate 8. In the casting position, the flow passage 2 of the valve plate 1 is aligned with the outlet flow passage of the furnace and corresponding flow passages of the top plate 7 and the bottom plate 8. The valve plate 1, corresponding to this presentation, projects with its closing surface section 4, therefore with that part which blocks the passage of molten metal in closing position of the three plate slide and guarantees the sealing between top plate 7 and bottom plate 8, laterally from out of the sliding valve.

According to the invention as shown in FIG. 2, a special heating conductor 3 in the form of two double spiral branches, lying within one another, is provided in the area of said closing surface section 4 of valve plate 1. The heating conductor 3, consisting of nichrome wire (80/20) is introduced into the valve plate 1 from the narrow side opposite the end 6 on the side of the closing surface. It always branches out at the branching points 5 into the two spiral branches, lying within one another. The outside spiral branch, at the same time is adapted to the contour of the valve plate (in the case shown, rectangularly), while the inside spiral branch runs together immediately behind the flow passage 2 toward the middle of the plate and again separates toward the end 6 on the closing surface side. In this way, one may achieve the most uniform possible temperature for the valve plate 1 during the casting process, both in the area of the flow passage 2 in order to avoid freezings-in as well as in the closing surface section 4 in order to avoid leaks of the sliding shutter. There may be provided an additional heating conductor 9 disposed at the outside part of the closing surface section and which is switched on electrically only in the casting position of the plate. While in the disclosed embodiments, the valve plate is flat it will be appreciated that the invention may be advantageously applied to the closing surface of arcuate valve plates; and while the sliding valve plate is shown to be reciprocated between casting and non-casting position, it will be appreciated that the flow passage 2 and the closing surface 4 can be rotated between casing and non-casting positions. The stationary upper and bottom plates 7 and 8 can form the outlet opening of a metalurgical vessel of the type shown in Swiss Pat. No. 444,390, incorporated herein by reference.

In case of a special embodiment, and in the case of the plate dimensions of 300 mm ×150 mm ×30 mm a heating spiral with a turn-diameter of 7.5 mm, a diameter of the wire of 1.0 mm and a turn-spacing of 5.6 mm was used successfully. From this resulted a ratio of plate thickness to turn-diameter of 4:1, a ratio of turn-diameter to wire diameter of 7.5:1 and a ratio of turn-spacing to distance of the top edge of the wire to the surface of the plate of 1:2.

In case of such an embodiment the spiral branches made of nichrom heating wires have for example a resistance of 7 ohm and the double spiral has a resistance of 3.5 ohm. In case of a voltage of 100 volt a current of 28.5 amps flows and the valve plate has a capacity of 2850 watt. The specific surface load lies at about 9.5 watt/cm$^2$ surface to the wire.

The closing surface of the valve element of the metal furnace is maintained at a uniform high temperature above the melting point of the molten metal in the furnace so that malfunctions in the valve structure and operation are avoided. For an aluminum furnace heating of the closing surface of valve plate to a temperature of 750° C., adherent aluminum is maintained in the molten state.

While the invention has been described in connection with preferred embodiments, it will be appreciated that the invention may be modified within the spirit and scope of the appended claims:

We claim:

1. A valve plate of sliding valve joints on vessels containing molten metal, said valve plate being constituted of a refractory material and having a flow passage therein for alignment with a flow passage in said vessel and a closing surface section for closing the flow passage in said vessel and has a molded-in electrical heating conductor, the improvement wherein the major portion of said heating conductor is disposed in said closing surface section of said plate to heat said closing surface section when the flow passage therein is in alignment with said flow passage in said vessel.

2. A valve plate as defined in claim 1, wherein said heating conductor surrounds the flow passage of said plate on the side of the closing surface section.

3. A valve plate as defined in claim 1, characterized in that the heating conductor is spirally wound.

4. A valve plate as defined in claim 2, wherein said heating conductor is a double spiral constituted by two spirally wound conducting branches and a pair of branch points commonly connected to the ends of each said spirally would conductor, respectively.

5. A valve plate as in claim 4, wherein the branching points of said double spiral lie in the refractory material of said plate and in that each of said branches of the double spiral have the same electric resistance.

6. Valve plate as defined in claim 1, wherein an additional heating conductor is disposed, along the outer edge of said closing surface section of said plate which additional heating conductor is switched on electrically only in the casting position of the plate.

7. Valve plate as defined in claim 6, wherein said heating conductors are provided in the portion nearest said flow passage and said outer edge part of the closing surface section of the plate, are formed as heating spirals and in that said heating conductor along the outer edge has a smaller spacing of turn than the heating conductor portion nearest said flow passage.

8. Valve plate as defined in claim 4 wherein the branches of the heat conductor are provided in the portion nearest said flow passage and along the outer edge of said closing surface section wherein the portion nearest said flow passage lies directly behind said flow passage in said closing surface section closer to the longitudinal center median plane of the plate than in the area of the flow passage.

9. Valve plate as defined in claim 1, characterized in that the heating conductor is constituted by nichrome wire.

10. Valve plate as defined in claim 3, wherein the ratio of the thickness of the plate to the diameter of the turn of the heating spiral lies between 3:1 and 6:1, preferably at about 4:1.

11. Valve plate as defined in claim 3 wherein that the ratio of diameter of the turn of the heating spiral to the diameter of the wire lies at about 6:1, preferably at about 7.5:1.

12. Valve plate as defined in claim 3, wherein that the ratio of the spacing of the turn of the heating spiral to the spacing of the upper edge of the heating wire to the surface of the plate (1) lies below 1:4, preferably at 1:2.

13. In a container containing metal melts having an outlet passage and a heated sliding valve element having a closing surface section for controlling the casting of molten metal therefrom, the improvement comprising means for electrically heating said closing surface section to above the melting point of the metal in said furnace to heat said closing surface section when said sliding valve element is in the casting position.

14. The invention defined in claim 10 wherein said metal contained in said container is aluminum and said means for electrically heating is a double spiral heating element embedded in the body of said sliding valve element.

15. Valve plate as defined in claim 1 wherein said heating conductor is embedded into a settable mass containing tabular-alumina, to constitute said closing surface.

16. Valve plate as defined in claim 15 wherein the embedding mass for the heating conductor is essentially free or organic substances, carbon, sulfur, metallic iron, alkalies and/or electrically conductive substances.

17. Valve plate as defined in claim 15 wherein the embedding mass is a a mass which can be vibrated into a form to completely fill out the form.

18. Valve plate as defined in claim 15 wherein the heating conductor is nichrome wire annealed in air prior to embedding.

19. Valve plate as defined in claim 15 wherein the embedding mass is of a grain size of maximally 1.1 to 1.3 times the spacing of the turn of the heating spiral.

20. The valve plate defined in claim 15 wherein the settable mass is hydraulically settable.

21. The valve plate as defined in claim 15 wherein said settable mass is chemically settable.

22. The invention defined in claim 15 wherein said settable mass includes calcium-aluminate cement and water.

23. The invention defined in claim 15 wherein said settable mass includes mono-aluminum phosphate.

* * * * *